US011772111B1

(12) United States Patent
Busch et al.

(10) Patent No.: US 11,772,111 B1
(45) Date of Patent: Oct. 3, 2023

(54) DISPENSER

(71) Applicant: Branded AcquiCo No 5, LLC, New York, NY (US)

(72) Inventors: Sean Busch, Austin, TX (US); Stuart Harvey Lee, Cornwall on Hudson, NY (US); Mark Robert Dorsey, New York, NY (US)

(73) Assignee: Branded AcquiCo No 5, LLC, New York, NY (US)

( * ) Notice: Subject to any disclaimer, the term of this patent is extended or adjusted under 35 U.S.C. 154(b) by 0 days.

(21) Appl. No.: 17/946,722

(22) Filed: Sep. 16, 2022

(51) Int. Cl.
*B05B 11/00* (2023.01)

(52) U.S. Cl.
CPC ..... *B05B 11/0038* (2018.08); *B05B 11/0013* (2013.01); *B05B 11/0054* (2013.01)

(58) Field of Classification Search
CPC ..... B05B 11/0038; B05B 11/0013; B05B 11/0054; B05B 11/2408; B05B 11/0008
See application file for complete search history.

(56) References Cited

U.S. PATENT DOCUMENTS 2,051,518 A * 8/1936 Cunningham ..... B05B 7/2408 220/325
2,263,843 A * 11/1941 Gaylord ..... B05B 7/2408 292/241
2,280,519 A * 4/1942 Beck ..... B05B 7/2408 239/428
3,080,989 A * 3/1963 Ramsbotham ..... B65D 83/384 222/394
3,157,317 A * 11/1964 Ramsbotham ..... B65D 83/38 292/218
3,198,399 A * 8/1965 Sagarin ..... B65D 83/205 222/325
3,540,628 A * 11/1970 Trosch ..... A45D 33/00 220/288
3,664,554 A * 5/1972 Shiozawa ..... A47G 19/24 222/325
4,676,408 A * 6/1987 Speitel ..... B65D 83/384 222/183
4,821,923 A 4/1989 Skorka
5,156,299 A 10/1992 De Caluwe et al.
5,642,838 A 7/1997 Stoody
5,875,936 A 3/1999 Turbett et al.
5,944,223 A 8/1999 Klima et al.
5,957,335 A 9/1999 Otto
6,041,969 A 3/2000 Parise
6,182,865 B1 2/2001 Bunschoten et al.
6,290,100 B1 9/2001 Yacko et al.
6,568,562 B1 5/2003 Klima, Jr. et al.
6,983,864 B1 1/2006 Cagle
7,066,354 B2 6/2006 Stank et al.
7,111,763 B2 * 9/2006 Masuda ..... B05B 11/1047 222/105
7,331,486 B2 2/2008 Mon et al.
(Continued)

OTHER PUBLICATIONS

[No Author Listed], Meet Eddi. https://meeteddi.com/. Publicly available at least as early as Sep. 16, 2022. 3 pages.

*Primary Examiner* — Patrick M. Buechner
*Assistant Examiner* — Randall A Gruby
(74) *Attorney, Agent, or Firm* — Wolf, Greenfield & Sacks, P.C.

(57) ABSTRACT

Designs and methods for using reusable dispenser for use with a vessel containing a fluid.

22 Claims, 5 Drawing Sheets

(56) References Cited

U.S. PATENT DOCUMENTS

| | | | | |
|---|---|---|---|---|
| 7,703,704 | B2 * | 4/2010 | Gohring | B05B 7/2408 220/4.07 |
| 8,152,025 | B2 | 4/2012 | Foster | |
| 8,261,943 | B2 | 9/2012 | Sim | |
| 8,794,474 | B2 | 8/2014 | Mueller et al. | |
| 9,604,766 | B2 | 3/2017 | Dyrbye et al. | |
| 9,764,346 | B2 * | 9/2017 | Johnson | B05B 7/2481 |
| D891,261 | S | 7/2020 | Reed et al. | |
| 10,974,885 | B2 * | 4/2021 | Yamauchi | B05B 11/026 |
| 11,161,675 | B2 | 11/2021 | Reed et al. | |
| 2007/0000948 | A1 | 1/2007 | Adler et al. | |
| 2022/0152639 | A1 * | 5/2022 | Moretti | B65D 41/005 |

* cited by examiner

DISPENSER

FIELD

Disclosed embodiments are related to reusable dispensers for dispensing liquids, such as cleaning and personal care products.

BACKGROUND

Cleaning products and personal care products such as soap, shampoo, and multi-purpose cleaners are often packaged in single-use containers that are discarded after the product is emptied. Such single-use containers frequently include a spray or pump dispenser which is discarded with the container.

SUMMARY

Reusable containers are increasingly popular with consumers who are interested in reducing plastic waste and costs. However, refilling a reusable container typically involves mixing and pouring concentrated chemicals and a measured amount of water through a small opening of the container to create a cleaning solution. These extra steps for the consumer, often resulting in spills, can be time consuming, frustrating, and messy. In addition, the concentrated chemicals often come in plastic or other one-use containers themselves, adding to the consumer's waste. Consumers may resort to the convenience of single-use containers to avoid the extra steps and mess required with reusable cleaning products and household goods.

In view of the above, the inventors have recognized and appreciated designs for a reusable dispenser that may be used with a disposable vessel containing a liquid (e.g., cleaning solution) that is easily opened and loaded into the dispenser to dispense the liquid from the vessel. Accordingly, a user is not required to mix or pour any liquids into the dispenser to refill the dispenser with a liquid cleaning product. In some embodiments, the vessel may be a metal can which may be recycled, thereby reducing the consumer's plastic waste. The metal can may include a stay-on tab opening that a consumer may easily and quickly pop open prior to inserting the can into the dispenser. Accordingly, the user may load a new, liquid filled can into the dispenser by simply popping open a tab, similar to opening a can of soda, and inserting the can into the dispenser. No mixing, twisting, or spilling of liquid may be involved. In addition, the vessel may be cheaper and easier to manufacture and dispose than a plastic dispenser, thereby increasing cost savings while simultaneously reducing waste.

In some embodiments, a dispenser includes an upper portion defining an upper cavity and having a sealing surface. The upper portion may include a dispensing section for dispensing a liquid, such as a pump dispenser, spray handle, etc. The dispenser may further include a lower portion defining a lower cavity. The upper and lower portions may be configured to engage with each other to define an interior space in which to receive a vessel, such as an aluminum can having a stay-on tab opening, containing a liquid. The upper portion may be configured to engage with the vessel at the sealing surface to define a liquid-tight seal and divide the interior space into a first section including a first part of the upper cavity and an interior of the vessel and a second section including a second part of the upper cavity and a part of the lower cavity that extends around the vessel.

The dispenser may be refilled quickly and easily by replacing a liquid-filled vessel in the interior space of the dispenser.

In some embodiments, the sealing surface may be within the upper cavity. The sealing surface may include an annular surface configured to press against the vessel and form the liquid-tight seal. The sealing surface arrangement of the upper portion may allow a user to reload a liquid-filled vessel into the dispenser by simply press-fitting the vessel into the sealing surface of the upper portion.

In some embodiments, the dispenser may include a gasket between the sealing surface and the vessel. The gasket may be attached to the vessel and/or attached to a rim of the vessel. In some embodiments, the dispenser may include the vessel and a portion of the vessel engaged by the sealing surface may be rigid. In some embodiments, the vessel may be a metal can that includes an upper rim and a container positioned below the upper rim. The metal can may include a lid joined to the container at the upper rim, and the lid may include a stay-on tab opening. In some cases, a gasket for engaging the sealing surface of the upper portion can be fixed or otherwise attached to the rim of the can.

In some embodiments, the upper and lower portions of the vessel may be configured to squeeze the vessel between the sealing surface and a part of the lower portion. For example, the lower portion may include a bottom and a sidewall that defines the lower cavity, and the upper and lower portions may be configured to engage with each other so as to squeeze the vessel between the sealing surface and the bottom of the lower portion. Such squeezing may aid in forming a liquid-tight seal between the vessel and the sealing surface.

In some embodiments, the dispensing section may be configured to receive liquid from the vessel for dispensing. The dispensing section may include a pump sprayer with a dip-tube configured to extend into the vessel to receive the liquid. In some embodiments, the upper portion may include a proximal end including an opening at which the dispensing section is located and a distal end configured to engage with the lower portion of the dispenser. The sealing surface may be located between the proximal end and the distal end, e.g., on an inner wall of the upper portion. In some embodiments, the upper cavity of the upper portion may have a volume that is 5% to 50% of a volume of the internal space. The lower cavity of the lower portion may receive a substantial portion of the vessel.

In some embodiments, the upper portion may include an engagement feature configured to engage with the vessel and support the vessel on the upper portion. In some embodiments, the engagement may be configured to engage with a rim of the vessel to suspend the vessel from the upper portion, e.g., the vessel can be supported to hang or depend from the upper portion by grasping and holding only the upper portion. In some embodiments, the engagement feature may include a clamp including a plurality of resilient tabs configured to engage with an outer portion of the rim of the vessel to suspend the vessel from the upper portion. The engagement feature can engage with the vessel by a press fit, interference fit or friction fit, e.g., such that the vessel is pressed into engagement with the engagement feature. Thus, in some cases, the engagement feature can engage the vessel without a threaded connection. The sealing surface may be positioned within a space defined by the engagement feature.

In some embodiments, the upper portion may include a lower periphery and the lower portion may include an upper periphery, and the lower and upper peripheries may be configured to engage with each other to attach the upper and lower portions together. In some embodiments, the lower and upper peripheries may be configured to threadedly engage with each other. The upper and lower portions may be configured to threadedly engage with each other and to urge the vessel into contact with the sealing surface, e.g., as the upper and lower portions are threadedly engaged, the vessel can be pressed into engagement with the sealing surface. In some embodiments, the upper and lower portions may be configured to sealingly engage with each other, e.g., at the outer peripheries to form a liquid-tight seal. This can enable the dispenser to hold and/or dispense liquid from the interior space, e.g., if the dispenser is used without a vessel.

In another aspect, a method of assembling a dispenser may include opening a vessel to permit access to a liquid in the vessel and engaging an upper part of the vessel with an upper portion of a dispenser by a press fit engagement so the vessel is suspended from the upper portion. The method may also include engaging the upper portion of the dispenser with a lower portion of the dispenser to enclose the vessel in an interior space of the dispenser defined by the upper and lower portions. As such, the dispenser may be refilled quickly and easily with a simple press-fitting motion of a liquid-filled vessel into an upper portion of the dispenser.

In some embodiments, engaging the upper part of the vessel may include extending a dip-tube of a pump sprayer on the upper portion into the vessel. The dip-tube may receive the liquid from the vessel to dispense via the pump sprayer.

In some embodiments, engaging the upper part of the vessel includes pressing a portion of the vessel into a clamp of the upper portion. The clamp may include a plurality of resilient tabs that engage with the vessel. Pressing a portion of the vessel into the clamp may include forcing the portion of the vessel into a space between the plurality of resilient tabs so that the resilient tabs elastically deform and engage with the vessel. In some embodiments, engaging the upper portion of the dispenser may include forming a liquid-tight seal between the vessel and the upper portion. Forming the liquid tight seal may include dividing the interior space into a first section including a first part of an upper cavity defined by the upper portion and an interior of the vessel and a second section including a second part of the upper cavity and a part of a lower cavity defined by the lower portion. In some embodiments, engaging the upper portion may include squeezing the vessel between the upper and lower portions. Squeezing the vessel between the upper and lower portions may include forming a liquid-tight seal between the vessel and the upper portion.

In another aspect, a dispenser may include an upper portion defining an upper cavity. The upper portion may have an engagement feature configured to engage with a vessel containing liquid with a press fit engagement suitable to suspend the vessel containing the liquid from the upper portion. The upper portion may also include a dispensing section for dispensing the liquid. The dispenser may also include a lower portion defining a lower cavity. The upper and lower portions may be configured to engage with each other to define an interior space in which to receive the vessel. In some embodiments, the upper portion may include a sealing surface configured to engage with the vessel to define a liquid-tight seal and divide the interior space into a first section including a first part of the upper cavity and an interior of the vessel and a second section including a second part of the upper cavity and a part of the lower cavity that extends around the vessel. The sealing surface may be within the upper cavity and may include an annular surface configured to press against the vessel and form the liquid-tight seal.

In some embodiments, the engagement feature may include a clamp configured to engage with the vessel and suspend the vessel from the upper portion. The clamp may be configured to engage with a rim of the vessel to suspend the vessel from the upper portion. In some embodiments, the engagement feature may include a plurality of resilient tabs configured to engage with a portion of the vessel to suspend the vessel from the upper portion. In some embodiments, the sealing surface may be positioned within a space defined by the plurality of resilient tabs.

In another aspect, a dispenser may include an upper portion and a lower portion configured to engage with each other to define an interior space to receive a vessel containing a liquid. The upper portion may include a sidewall between a first opening configured to engage the lower portion and a second opening through which the liquid is dispensed from the vessel. The dispenser may also include an engagement feature on an interior of the sidewall between the first and second opening configured to engage with a portion of the vessel and retain the vessel on the upper portion. In some embodiments, the upper portion may be configured to engage with the vessel to form a sealed cavity between the upper portion and the vessel, and the liquid may be configured to flow from the vessel through the sealed cavity and out the second opening.

In some embodiments, the dispenser may include a sealing surface on the interior of the sidewall. The upper portion may be configured to engage with the vessel at the sealing surface to define a liquid-tight seal and form a cavity defined by the interior of the sidewall and an interior wall of the vessel. In some embodiments, the sealing surface may be positioned between the engagement feature and the second opening. In some embodiments, the sealing surface may be positioned within a space defined by the engagement feature. In some embodiments, the sealing surface may include an annular surface configured to press against the vessel and form the liquid-tight seal.

In another aspect, a vessel for use in a dispenser may include a container with a lid connected to the container at a rim. A portion of the lid may be opened to access an interior of the container, e.g., the lid can include a stay-on tab opening that can be operated to open the vessel. The vessel may also include a gasket attached to the rim configured to form an air-tight seal between the rim and a sealing surface of a dispenser. In some embodiments, the lid and/or the container may be rigid. A rigid lid and/or container may allow the vessel to be press-fitted into a portion of the dispenser and engaged and/or suspended by an engagement feature of the dispenser. In some embodiments, the gasket may be adhered to or fixed to the rim of the vessel. In some embodiments the gasket may be damaged by removal from the rim. The gasket may have an annular shape or may comprise an elastic material. In some embodiments, the vessel may be a metal can. The metal may be a recyclable material, such as aluminum, reducing the user's plastic waste. In some embodiments, the container may be a cylindrically shaped container. The container and the lower portion of the dispenser may be shaped and sized such that the vessel fits substantially within the lower portion of the dispenser.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

Figure 1:
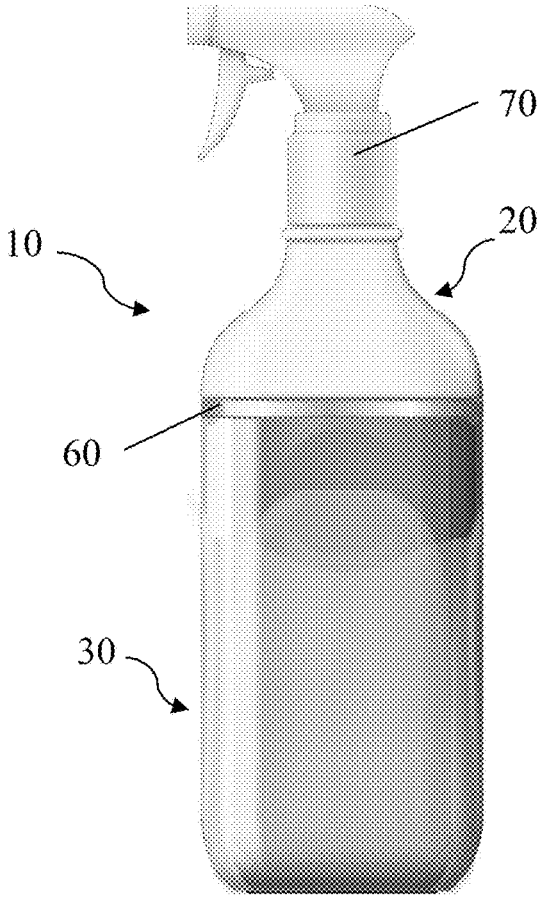
FIG. 1 illustrates an embodiment of a dispenser.
Figure 2:
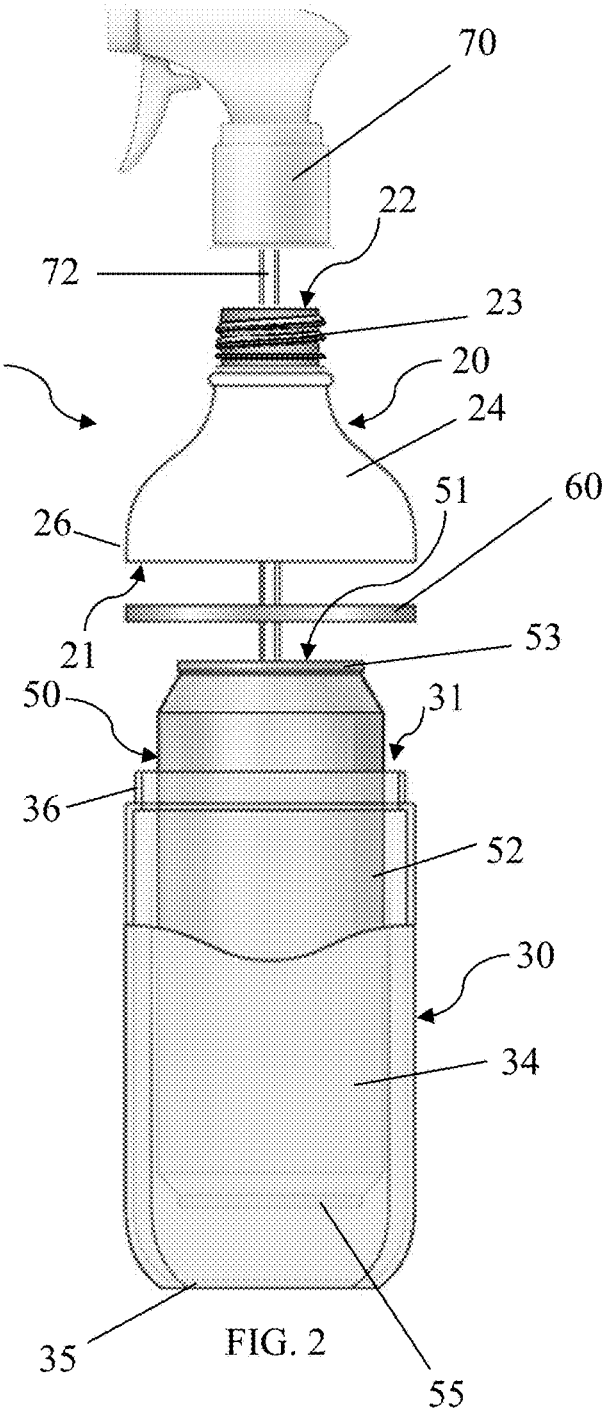
FIG. 2 illustrates an exploded view of the dispenser of FIG. 1.

FIGS. 1 and 2 illustrate front views of a dispenser 10 that incorporates features of the disclosure. FIG. 1 shows the dispenser in an assembled configuration and FIG. 2 shows an exploded view of the dispenser 10 in an unassembled configuration with a vessel 50 being inserted into the dispenser. The vessel 50 may contain any suitable liquid such as a solution or other material used for cleaning, household, or personal care (e.g., multi-purpose cleaner, hand soap, laundry detergent, shampoo, etc.). As shown in the figures, the dispenser 10 may include an upper portion 20 and a lower portion 30 that engage with each other to form an interior space to receive the vessel 50. The upper portion 20 may include a first opening 21 configured to engage with an opening 31 of the lower portion. Each of the openings 21, 31 may be sized with a sufficient diameter such that a portion of the vessel may fit into the openings 21, 31 and into the interior space formed by upper and lower portions 20, 30.

The upper portion 20 may have a second opening 22 configured to dispense a liquid. In some embodiments, the second opening 22 may be configured to receive a dispensing portion 70. As shown in FIGS. 1 and 2, the dispensing portion 70 may be a pump sprayer having a dip tube 72 configured to extend into an interior of the vessel 50 for dispensing a liquid from the vessel 50. Although a pump sprayer is shown in the figures, the dispensing portion 70 may include any appropriate pump or dispensing mechanism, including but not limited to lock down pumps, lock up pumps, cream pumps, mini-trigger pumps, foamer pumps, top dispensers, crimp pumps, powder spray, trigger spray, drippers, nozzles, etc. In some embodiments, the dispenser 10 may dispense a liquid directly through the second opening 22 without a separate dispensing portion 70. For example, in some embodiments, a cap may be attached to the opening 22 to selectively seal the second opening 22. The cap can be made removable to uncover the opening 22 and allow liquid to be poured or otherwise dispensed from the vessel 50. In some embodiments, the second opening 22 may include a threaded portion 23 to engage a dispensing portion 70 or a cap with corresponding threads; however, the disclosure is not so limited, and the upper portion 20 may include any appropriate attachment means for receiving a cap or dispensing portion 70 (e.g., press-fit, snap on, detents, latches, etc.).

As shown in the figures, an upper portion 20 of the dispenser 10 may include a sidewall 24 that extends between the first and second openings 21, 22. As shown in the figures, the first and second openings 21, 22 may be positioned on opposite ends of the sidewall 24 such that the second opening 22 is opposite the lower portion 30. The sidewall 24 may have an outwardly tapered shape extending from the second opening 22 to the first opening 21. In some embodiments, the first and second openings 21, 22 may be concentrically arranged with sidewall 24. For example, a vertical axis may extend through a geometric center of the first and second openings 21, 22 and the sidewall 24. Other arrangements of the first and second openings and sidewall of the upper portion 20 may be employed. In some embodiments, the second opening 22 may be positioned on a sidewall 24 so the second opening 22 is arranged in a plane that is parallel to a plane of the first opening 21 as shown, or arranged in a plane that is not parallel to the first opening 21 (e.g., the second opening 22 could be arranged in a plane that is perpendicular to a plane of the first opening 21 or at any other suitable angle between 0 and 180 degrees).

The lower portion 30 may have a generally cylindrical shape including a sidewall 34 and a closed bottom 35 opposite opening 31. The lower portion 30 may be sized and shaped to receive a substantial portion of the vessel 50, such as 50%, 70%, 80% or more of a height of the vessel 50. A bottom 55 of the vessel 50 may contact and be supported by an interior surface of the closed bottom 35 of the lower portion 30, or the bottom 55 of the vessel 50 can be suspended above the bottom 35 of the lower portion 30. The lower portion 30 and the vessel 50 may be similarly shaped such that the vessel occupies a substantial volume of the lower portion. In some embodiments, at least a portion of the sidewall 34 may be transparent to allow a user to view the vessel through the lower portion. For example, an exterior surface of the vessel 50 may include a design, advertising indicia, list of ingredients, or identify the type of liquid contained therein and a transparent portion of the lower portion 30 may allow a user to confirm what type of liquid is held in the dispenser. The upper and lower portions 20, 30 may be formed of any suitable material (e.g., plastic, glass, etc.).

In some embodiments, a vessel 50 may include a lid 51 connected to a container 52 at a rim 53. At least a portion of the vessel 50 may be made of a rigid material and/or be rigid in at least some directions. For example, the lid 51 and/or the container 52 may be rigid in a vertical direction (i.e., a direction along which the sidewall of the container 52 extends. In some embodiments, the vessel 50 may be a metal can made of a recyclable material such as aluminum. As described in more detail below with respect to FIG. 3, a user may simply press a vessel into engagement with the upper portion. For example, a part of the upper portion 20 may engage a rim of the vessel 50 such that the vessel may be suspended from and entirely supported by the upper portion 20. A user may then attach the lower portion 30 to the upper portion 20 to secure the vessel between the upper and lower portions of the dispenser. Alternatively, a user may insert the vessel 50 into the lower portion 30 and then attach the upper portion 20 to the lower portion 30 to secure the vessel 50 within the dispenser. In such a case, the vessel 50 may be engaged with the upper portion 20 so the vessel 50 can be suspended from the upper portion 20, or not. In some cases, the vessel may be compressed between the upper and lower portions when they are engaged.

In some embodiments, a portion of the lid 51 may be opened to access a liquid contained in the vessel 50. In some embodiments, the lid 51 of the vessel may include a stay-on tab opening that a user may pop open prior to inserting the vessel into upper and lower portions of the dispenser. When assembling a liquid-filled vessel with the dispenser, the dip tube 72 of a dispensing portion 70 may extend into the vessel 50 through an opening in the lid 51. Alternatively, a dip tube 72 may be configured to pierce or otherwise open a portion of the lid 51 as the dip tube extends into the vessel 50. The dispensing portion 70 with dip tube 72 may be attached to the upper portion before or after the upper portion is engaged with the vessel 50 and/or the lower portion 30. When a vessel 50 inside a dispenser 10 has been emptied or if a user wishes to change the liquid being dispensed from the dispenser 10, a user may disengage the upper and lower portions 20, 30 of the dispenser, remove the vessel, insert a new liquid-filled vessel, and then reengage the upper and lower portions to secure the new vessel in place. Used vessels may be recycled.

The design of the dispenser with an upper portion and a lower portion that are selectively engageable allows the dispenser to be easily refilled and reused. For example, a vessel 50 having a size, shape, and volume similar to the interior space of the dispenser may be inserted and/or removed from the dispenser 10 via openings 21, 31 of the upper and lower portions. As such, a user may simply refill the dispenser 10 to full or nearly full volume by disengaging the upper and lower portions and exchanging an empty vessel with a new liquid-filled vessel. Therefore, a user is not required to refill the dispenser through a single dispensing opening, which typically has a small diameter, avoiding unnecessary spills and messes.

In some embodiments, the upper portion 20 may include a lower periphery 26 that engages with an upper periphery 36 of the lower portion 30 to attach the upper and lower portions 20, 30 together. As shown in FIG. 2, the lower periphery 26 may fit snugly over an indented upper periphery 36 such that sidewalls 24, 34 form a smooth surface transition between the upper and lower portions 20, 30. The lower and upper peripheries may have any appropriate attachment means that allow the upper and lower portions 20, 30 to be disengaged from and engaged to each other (e.g., compression fit, detents, threaded engagement, twist lock, bayonet connection, etc.). Easy disengagement and engagement of the upper and lower portions allows a vessel 50 to be quickly and effortlessly removed from and replaced by another vessel 50. In some embodiments, the lower and upper peripheries 26, 36 may include corresponding internal and/or external threads such that the lower and upper portions 20, 30 may be configured to threadedly engage with each other (see FIG. 3). In some embodiments, the upper and lower portions 20, 30 may sealingly engage with each other. As shown in FIGS. 1 and 2, a gasket 60 may be arranged between the lower periphery 26 and the upper periphery 36 to form a liquid-tight seal between the upper and lower portions 20, 30. Threaded engagement of the upper and lower portions 20, 30 may squeeze the gasket 60 between the portions 20, 30, forming a liquid-tight seal for the interior space of the dispenser. As such, any liquid in the dispenser 10 may be contained within and not leak from the dispenser between the upper and lower portions.

In some embodiments, the dispenser 10 may be used to dispense liquid without a vessel in the interior space. For example, a liquid may be added directly to and dispensed from the interior space formed by the upper portion 20 and the lower portion 30 of the dispenser 10. As such, the dispenser 10 may be refilled with a liquid with or without a vessel 50. Gasket 60 may prevent any liquid from leaking out of the dispenser 10.

Figure 3:
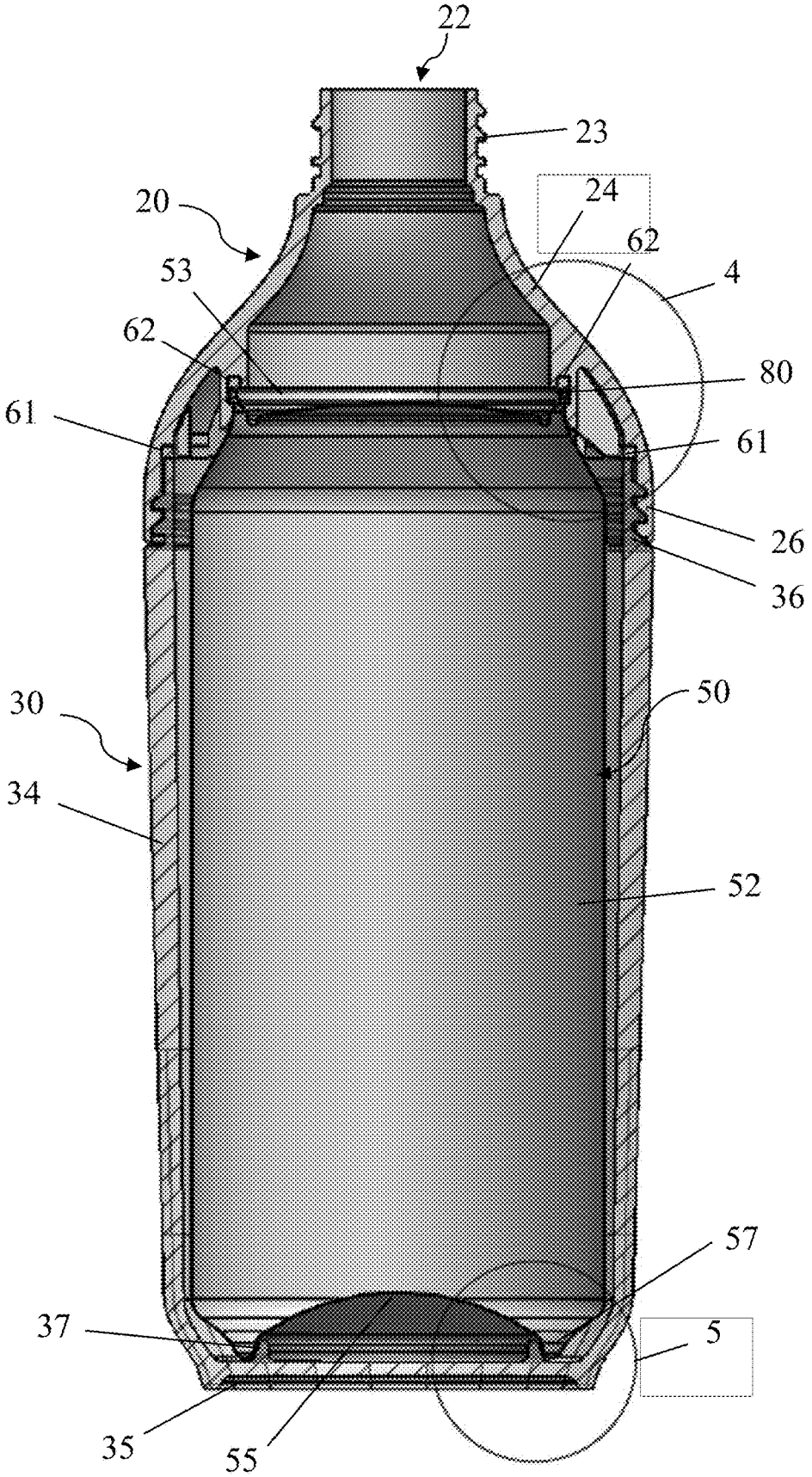
FIG. 3 illustrates a longitudinal cross-sectional view of a vessel received in an upper portion and lower portion of a dispenser, such as that in FIG. 1.

FIG. 3 illustrates a longitudinal cross-sectional view of a vessel 50 supported in an interior space defined by upper and lower portions 20, 30 of a dispenser 10. A dispensing portion is not shown in FIG. 3, but a dispensing portion (such as a cap) may be attached to the second opening 22 via a threaded portion 23. As shown in FIG. 3, the upper portion 20 and lower portion 30 are engaged with each other at lower and upper peripheries 26, 36, respectively. The lower and upper peripheries 26, 36 may have corresponding threads to threadedly engage with each other to tightly secure the upper and lower portions together. A first gasket 61 may be disposed between the lower and upper peripheries to form a liquid-tight seal between the upper and lower portions. In the FIG. 2 embodiment, a gasket 60 is configured between the upper and lower portions 20, 30 such that the gasket 60 is exposed at an outer surface of the dispenser 10. In FIG. 3, the gasket 61 is located inside the outer surface of the dispenser 10, e.g., between an upper edge of the lower portion 30 and an inner surface of the upper portion 20.

As shown in FIG. 3, a sidewall 24 of the upper portion 20 defines an upper cavity. Sidewall 24 may have a tapered cylindrical or conical shape between the first opening 21 and second opening 22. In the lower portion 30, sidewall 34 and bottom 35 define a lower cavity. When the upper and lower portions are engaged as shown, the upper and lower cavities define an interior space to receive a vessel 50. As shown in FIG. 3, the vessel may occupy a majority of the lower cavity of the lower portion 30 and a portion of the upper cavity of the upper portion 20. Alternatively, a liquid may be introduced into the interior space of the upper and lower portions without a vessel.

Figure 4:
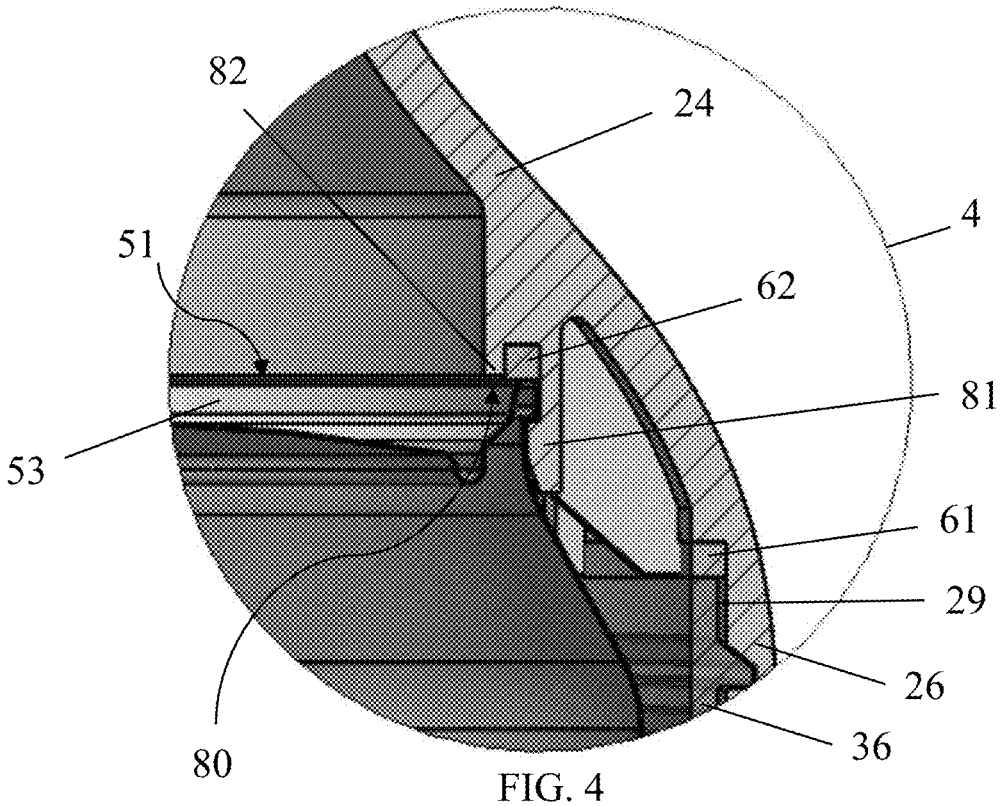
FIG. 4 illustrates an enlarged view of a portion of FIG. 3 identified by the circle 4.

In some embodiments, the vessel 50 may be secured in the interior space between the upper and lower portions 20, 30. An interior portion of the upper portion 20 may include a sealing surface 80 for engaging the vessel 50. In some embodiments, the sealing surface 80 may be an annular sealing surface arranged on an interior of sidewall 24 of the upper portion, e.g., between the first and second openings 21, 22. In some cases, the sealing surface 80 can have a diameter or other size that is larger than the second opening 22, e.g., a diameter at least 20% to 50% larger than a diameter of the second opening 22. The sealing surface 80 can have a diameter or other size that is smaller than the first opening 21, e.g., a diameter at least 20% to 50% smaller than a diameter of the first opening 21. The sealing surface 80 can be arranged on an inner surface of the sidewall 24 that can taper downwardly and radially outwardly from the second opening 22. The sealing surface 80 can be on a part of the inner surface of the sidewall 24 that is located between the first and second openings 21, 22. As shown in FIGS. 3 and 4, a rim 53 of the vessel 50 may be pressed against the sealing surface 80 to form a liquid-tight seal between the vessel and the sealing surface. A second gasket 62 may be arranged between the sealing surface 80 and the vessel 50 to form a liquid-tight seal. The gasket 62 can engage the vessel 50 in any suitable location, such as at a rim of the vessel, a tapered sidewall portion around the vessel rim, an area of the lid of the vessel, etc. In some embodiments, the second gasket 62 may be a reusable gasket that is held, adhered or otherwise provided at the sealing surface 80 of the upper portion such that the second gasket may be reused with multiple vessels. In some embodiments, the second gasket 62 may be adhered or otherwise fixed to the vessel. For example, the second gasket 62 may be fixed to a rim of the vessel. In some embodiments, the gasket 62 may be made of an elastic or deformable material, and the gasket may be damaged upon removal from the vessel 50. By providing a gasket 62 attached to a vessel 50, a user may enjoy a new gasket for each vessel 50 employed with the dispenser 10. This may help ensure that a suitable liquid-tight seal is created between the vessel 50 and the upper portion 20.

As shown in FIG. 3, when a vessel 50 is engaged with the sealing surface 80 of the upper portion 20, the interior space within the upper and lower portions may be divided into a first section that includes a first part of the upper cavity (i.e., between sealing surface 80 and second opening 22) and an interior of the vessel, and a second section that includes a second part of the upper cavity (i.e., between sealing surface 80 and first opening 21) and a part of the lower cavity that extends around the vessel. In some embodiments, the first part of the upper cavity may have a volume that is 5% to 50% of a volume of the internal space. In some embodiments, the first part of the upper cavity can have a diameter or other size in at least one portion that is larger than a diameter or other size of the second opening 22.

Liquid from the vessel 50 may flow into the first section of the interior space and may be dispensed out of the second opening 22, e.g., by pouring the liquid from the second opening 22 or via a dispensing portion. The vessel 50 and upper portion 20 forming a liquid-tight seal at the sealing surface 80 contains the liquid in the first section and prevents liquid from leaking into the second section, e.g., into the lower cavity defined by the lower portion 30. If liquid happens to breach the sealing surface 80, the first gasket 61 may help prevent any liquid from further leaking out of the dispenser through the upper and lower portion junction. The vessel 50 and upper portion 20 may be configured so that any liquid in the first section of the interior space tends to flow back into the vessel when the dispenser 10 is oriented in an upright position, e.g., so the second opening 22 is above the bottom 55 of the dispenser as shown in FIG. 3. This may, for example, route liquid in the first section into the vessel and to a location where the liquid can be picked up by a dip tube or other portion of a dispensing section that extends into the vessel 50. In addition, configuring the upper portion 20 and the vessel 50 so that liquid flows by gravity from the first section into the vessel may help prevent liquid from being spilled when removing a vessel 50 from the dispenser 10, e.g., because liquid will drain into the vessel 50 rather than be present in the first section.

Figure 5:
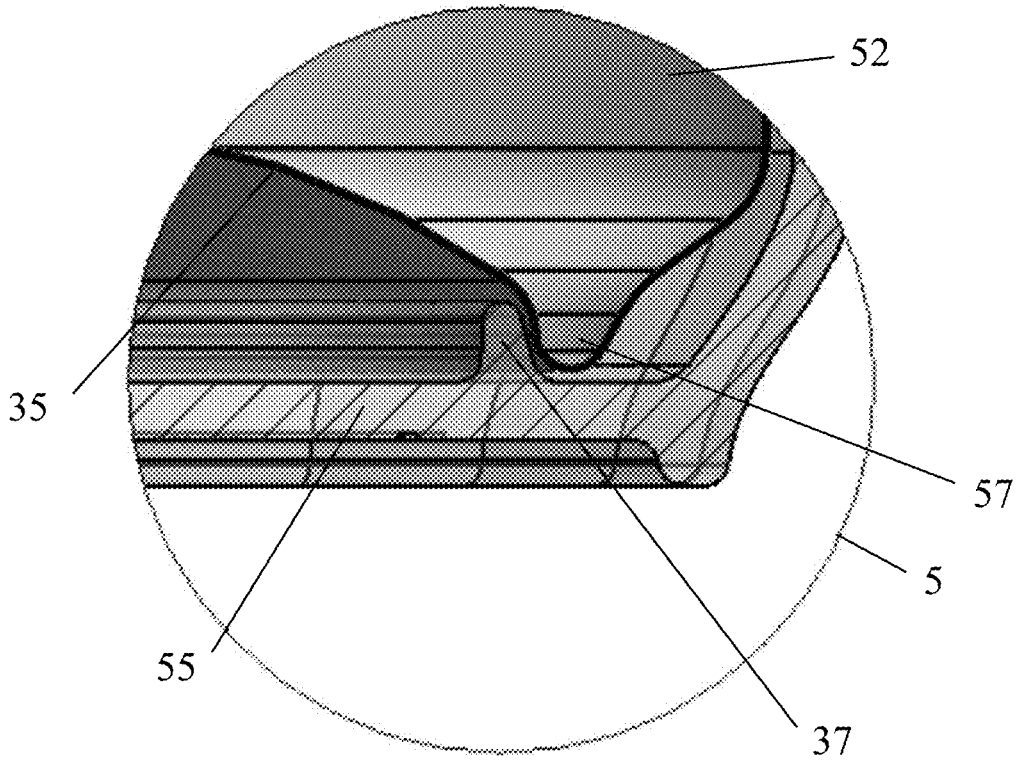
FIG. 5 illustrates an enlarged view of a portion of FIG. 3 identified by the circle 5.

In some embodiments, as described above, the vessel 50 may be a rigid vessel such as a metal can, and may be squeezed or otherwise compressed between the upper and lower portions 20, 30. As shown in FIGS. 3 and 5, the vessel 50 may have a bottom 55 that contacts and is supported by a bottom 35 of the lower portion 30. In some embodiments, lower portion 30 may include an annular ridge that extends an inner surface of the bottom 35 to engage and an annular ridge 57 of the vessel to stabilize or otherwise position the vessel within the lower portion. As the upper and lower portions are brought together, the bottom 35 of the lower portion 30 may press against the bottom 55 of the vessel to urge the vessel into contact with the sealing surface 80. As a non-limiting example, lower and upper peripheries 26, 36 may threadedly engage with each other while simultaneously compressing the vessel between the upper and lower portions, pressing the rim 53 of the vessel against a gasket 62 and/or the sealing surface 80.

As shown in FIGS. 3 and 4, the upper portion 20 of the dispenser may include an engagement feature 81 that engages the vessel to support the vessel 50 on the upper portion 20. The engagement feature 81 may be configured to engage a rim 53 or other portion of the vessel to suspend the vessel from the upper portion 20. In some embodiments, the engagement feature 81 may be configured to latch onto the rim of the vessel when the vessel is press fit into the upper portion. The engagement feature 81 may prevent the vessel from rotating relative to and/or disengaging from the upper portion 20 at least with respect to rotation and pulling forces below a threshold.

In some embodiments, the engagement feature may include a clamp configured to engage with the vessel. The clamp may engage with a rim 53, sidewall, lid or other part of the vessel to suspend the vessel from the upper portion 20. In some embodiments, the engagement feature may include a plurality of resilient tabs 81 arranged on an inner surface of sidewall 24 and configured to engage the rim 53 of vessel 50. The sealing surface 80 may be positioned within a space defined by the plurality of resilient tabs 81. The resilient tabs 81 may latch onto the rim 53 as the vessel is press fit into the upper portion. The distal end of the resilient tabs 81 may have a slightly tapered shape to allow the rim 53 to easily deform the tabs radially outwards as the rim 53 is inserted into the space between the tabs 81. The tabs 81 may function as a detent, holding the vessel 50 to the upper portion 20 unless a suitable force above a threshold is applied to pull the vessel 50 and upper portion 20 apart.

Figure 6:
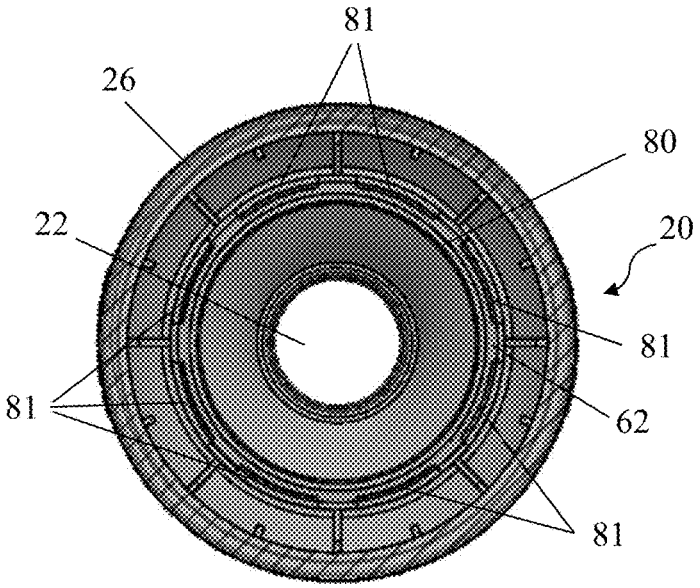
FIG. 6 illustrates a bottom view of an upper portion of a dispenser, according to an embodiment.
Figure 7:
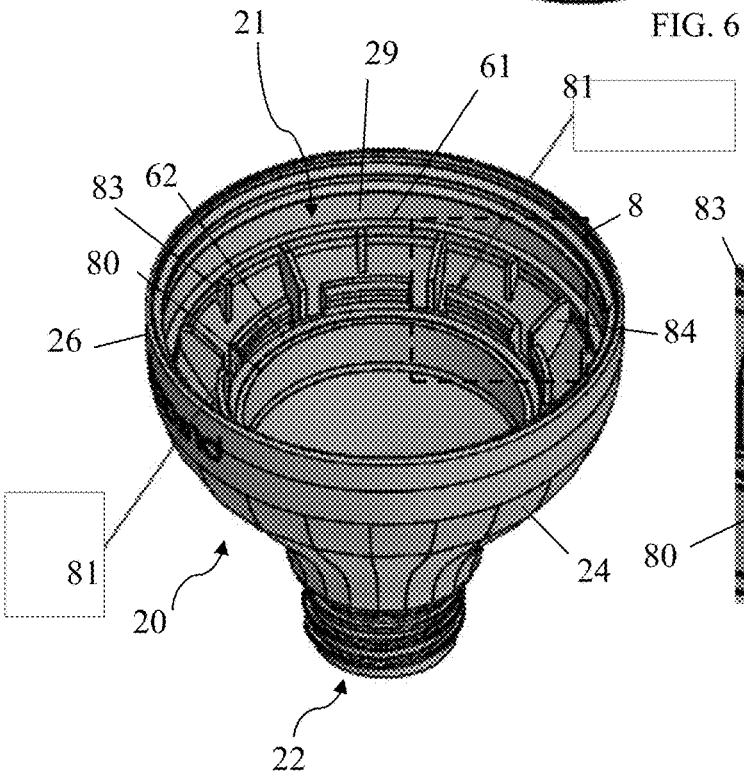
FIG. 7 illustrates a bottom perspective view of the upper portion of FIG. 6.
Figure 8:
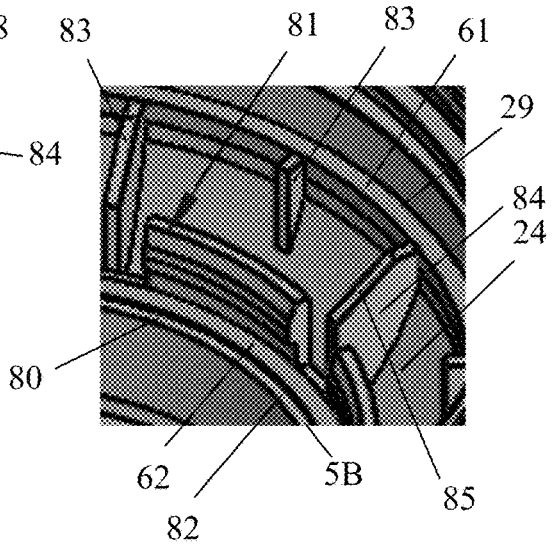
FIG. 8 illustrates an enlarged view of box 8 of FIG. 7.
Figure 9:
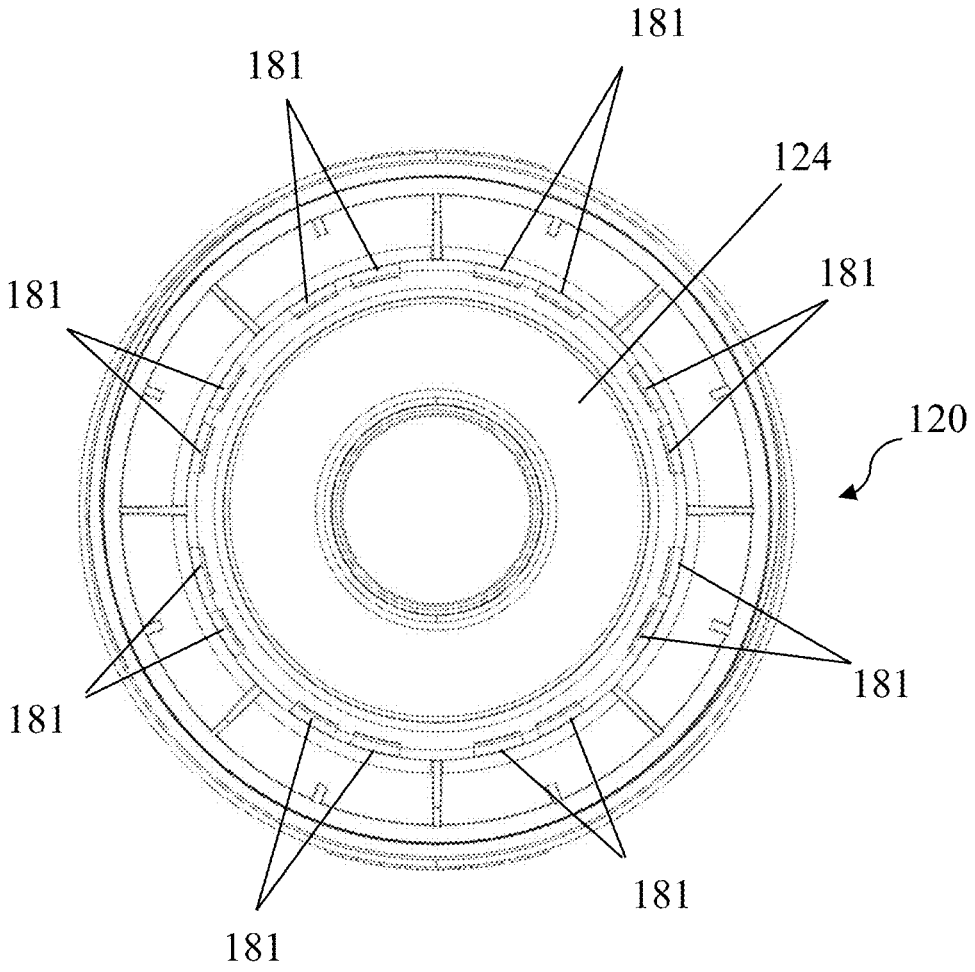
FIG. 9 illustrates a bottom view of an upper portion of a dispenser, according to an embodiment.

FIGS. 6-8 illustrate an interior view of an upper portion 20 of a dispenser. As shown in FIGS. 6-8, eight resilient tabs 81 may be equally spaced on an inner surface of sidewall 24. Each of the resilient tabs 81 may have a slightly curved shape as viewed in FIG. 6, e.g., to match a curved shape of a portion of the vessel 50 to be engaged by the tabs 81 and an arc length longer than spaces between the resilient tabs. As shown in FIG. 9, in some embodiments, an upper portion 120 of a dispenser may have sixteen resilient tabs 181 arranged around an inner surface of sidewall 124. The resilient tabs 181 may be grouped in eight pairs that are equally spaced around a circular circumference. A space between each pair may be larger than a space between the resilient tabs 181 in each pair. Although embodiments of an upper portion are shown and described as having eight and sixteen resilient tabs in FIGS. 6 and 9, respectively, it should be appreciated that any number of resilient tabs may be arranged in any pattern.

As shown in FIGS. 7-8, a leading edge of the tabs 81 may be tapered downwardly and outwardly as can be seen in FIG. 8, e.g., so that a leading end of the vessel 50 can contact the tabs 81 and move the tabs 81 radially outwardly as the vessel portion is received by the tabs 81. Each tab 81 can have a hook or catch above the tapered leading edge, e.g., to engage with a rim of the vessel 50 that has a radially outwardly protruding portion. The sealing surface 80 and/or a gasket 62 can be configured in a space defined by the tabs 81, e.g., so that a portion of the vessel received into the space between the tabs 81 is guided into engagement with the sealing surface 80/gasket 62.

As described above, first opening 21, second opening 22, and sidewall 24 may be concentrically aligned. In some embodiments, a first gasket 61 may be an annular gasket positioned on an interior ledge of sidewall 24 adjacent to and spaced radially inward from a periphery 26 of the upper portion 20. The first gasket 61 may be supported between an interior portion 29 of sidewall 24 (see also FIG. 4) and a plurality of radially extending ribs 83, 84 arranged around an inner circumference of the sidewall 24. A second gasket 62 may be arranged on a sealing surface 80. In some embodiments, the sealing surface 80 may be an annular surface on an interior of sidewall 24. The second gasket 62 may be supported between the plurality of resilient tabs 81 and a ridge 82 of the sealing surface (see FIG. 4). Ribs 84 may extend radially inward to the sealing surface 80 to provide additional support to the second gasket 62. As noted above, the second gasket 62 may be provided with the dispenser 10 such that it may be reused with multiple vessels. Alternatively, in some embodiments, the second gasket 62 may be adhered or fixed to a vessel. In such embodiments, the second gasket 62 may be pressed into the sealing surface 80, between resilient tabs 81, ridge 82, and/or ribs 84, when the vessel is engaged with the upper portion 20.

In some embodiments, as best shown in FIG. 8, each rib 84 may have an angled outer surface 85 that slopes downwardly and outwardly toward the sealing surface 80. The angled outer surface 85 of each rib 84 may act as a guide to help urge a portion of a vessel toward the sealing surface 80 to engage the vessel with the sealing surface. Accordingly, a user may engage a vessel with the sealing surface 80 even if the user inserts the vessel askew or off centered from the sealing surface. The ribs 84 may guide the vessel into the appropriate position to properly engage with the sealing surface.

In some embodiments, a vessel 50 can be assembled with a dispenser 10 by opening the vessel so a liquid contained in the vessel can be accessed. In some cases, this may be done by operating a stay-on tab opening on a lid of the vessel 50. With the vessel opened, the vessel can be engaged with the upper portion 20 of the dispenser 10. This can include extending a dip tube or other portion of a dispensing section into the interior of the vessel. The upper portion 20 can be pressed onto the vessel 50, e.g., so that a rim or other part of the vessel 50 is engaged by a clamp located in a cavity of the upper portion 20. The vessel 50 can be engaged with the upper portion so that the vessel 50 is suspended from the upper portion 20. The suspected vessel 50 can be positioned in a cavity of the lower portion 30, and the upper and lower portions 20, 30 engaged, e.g., so the vessel 50 is compressed between the upper and lower portions 20, 30 and a liquid-tight seal is established between the vessel and the upper portion 20. Liquid in the vessel 50 can be dispensed, e.g., using a pump sprayer.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

The invention claimed is:

1. A dispenser comprising:

an upper portion defining an upper cavity and having a sealing surface, the upper portion including a dispensing section for dispensing a liquid; and a lower portion defining a lower cavity, the upper and lower portions being configured to engage with each other to define an interior space in which to receive a vessel containing a liquid;

wherein the upper portion is configured to engage with the vessel at the sealing surface to define a liquid-tight seal and divide the interior space into a first section including a first part of the upper cavity and an interior of the vessel and a second section including a second part of the upper cavity and a part of the lower cavity that extends around the vessel;

wherein the upper portion includes an engagement feature configured to engage with the vessel and support the vessel on the upper portion.

2. The dispenser of claim 1, wherein the sealing surface is within the upper cavity.

3. The dispenser of claim 1, wherein the sealing surface includes an annular surface configured to press against the vessel and form the liquid-tight seal.

4. The dispenser of claim 3, further comprising a gasket between the sealing surface and the vessel.

5. The dispenser of claim 4, wherein the gasket is attached to the vessel.

6. The dispenser of claim 5, wherein the gasket is fixed to a rim of the vessel.

7. The dispenser of claim 1, further comprising the vessel and wherein a portion of the vessel engaged by the sealing surface is rigid.

8. The dispenser of claim 1, wherein the upper and lower portions are configured to squeeze the vessel between the sealing surface and a part of the lower portion.

9. The dispenser of claim 1, wherein the lower portion includes a bottom and a sidewall that define the lower cavity, and wherein the upper and lower portions are configured to engage with each other so as to squeeze the vessel between the sealing surface and the bottom of the lower portion.

10. The dispenser of claim 1, wherein the dispensing section includes a pump sprayer with a dip tube configured to extend into the vessel to receive the liquid.

11. The dispenser of claim 1, further comprising the vessel which is a metal can including an upper rim and a container positioned below the upper rim.

12. The dispenser of claim 11, wherein the metal can includes a lid joined to the container at the upper rim, the lid including a stay-on tab opening.

13. The dispenser of claim 1, wherein the engagement feature is configured to engage with a rim of the vessel to suspend the vessel from the upper portion.

14. The dispenser of claim 13, wherein the engagement feature includes a plurality of resilient tabs configured to engage with an outer portion of the rim of the vessel to suspend the vessel from the upper portion.

15. The dispenser of claim 13, wherein the sealing surface is positioned within a space defined by the engagement feature.

16. The dispenser of claim 1, wherein the upper portion includes a lower periphery and the lower portion includes an upper periphery, the lower and upper peripheries configured to engage with each other to attach the upper and lower portions together.

17. The dispenser of claim 1, wherein the upper and lower portions are configured to threadedly engage with each other and to urge the vessel into contact with the sealing surface.

18. The dispenser of claim 1, wherein the upper and lower portions are configured to sealingly engage with each other.

19. The dispenser of claim 1, wherein the lower portion includes a window through which a portion of the vessel can be visualized.

20. The dispenser of claim 1, wherein the upper portion includes a proximal end including an opening at which the dispensing section is located and a distal end configured to engage with the lower portion, and wherein the sealing surface is located between the proximal end and the distal end.

21. The dispenser of claim 1, wherein the first part of the upper cavity has a volume that is 5% to 50% of a volume of the internal space.

22. The dispenser of claim 1, wherein the first part of the upper cavity extends over a lid of the vessel.

* * * * *